US010036299B2

(12) United States Patent
Achiwa et al.

(10) Patent No.: US 10,036,299 B2
(45) Date of Patent: Jul. 31, 2018

(54) EXHAUST APPARATUS OF OUTBOARD MOTOR

(71) Applicant: SUZUKI MOTOR CORPORATION, Hamamatsu-Shi, Shizuoka-Ken (JP)

(72) Inventors: Tetsushi Achiwa, Hamamatsu (JP); Keisuke Daikoku, Hamamatsu (JP)

(73) Assignee: SUZUKI MOTOR CORPORATION (JP)

( * ) Notice: Subject to any disclaimer, the term of this patent is extended or adjusted under 35 U.S.C. 154(b) by 235 days.

(21) Appl. No.: 15/057,188

(22) Filed: Mar. 1, 2016

(65) Prior Publication Data

US 2016/0177805 A1 Jun. 23, 2016

Related U.S. Application Data

(63) Continuation of application No. PCT/JP2015/060468, filed on Feb. 4, 2015.

(30) Foreign Application Priority Data

Apr. 10, 2014 (JP) ..... 2014-081045
Apr. 10, 2014 (JP) ..... 2014-081046

(51) Int. Cl.

| | |
|---|---|
| ***F01N 13/00*** | (2010.01) |
| ***B63H 20/24*** | (2006.01) |
| ***F01N 13/10*** | (2010.01) |
| ***F01N 3/10*** | (2006.01) |

(52) U.S. Cl.

CPC ..... *F01N 13/004* (2013.01); *B63H 20/24* (2013.01); *F01N 3/10* (2013.01); *F01N 13/001* (2013.01);

(Continued)

(58) Field of Classification Search

CPC .... F01N 13/004; F01N 13/10; F01N 2260/00; F01N 2590/021

See application file for complete search history.

(56) References Cited

U.S. PATENT DOCUMENTS 4,900,282 A * 2/1990 Takahashi ..... B63H 20/245 440/89 H
5,203,167 A * 4/1993 Lassanske ..... F01N 3/28 440/89 C (Continued)

FOREIGN PATENT DOCUMENTS

JP 04134117 A * 5/1992 ..... F01N 3/2807
JP 2005-202741 A 8/1993

(Continued)

OTHER PUBLICATIONS

International Search Report of PCT/JP2015/060468 dated Jun. 23, 2015.

*Primary Examiner* — Patrick Maines
(74) *Attorney, Agent, or Firm* — Barnes & Thornburg LLP

(57) ABSTRACT

An exhaust apparatus of an outboard motor equipped with a four-stroke engine includes an exhaust pipe having a cylindrical shape and being connected to an exhaust passage of an engine holder, wherein the exhaust pipe is disposed in an exhaust passage of the exhaust manifold in a manner being erected upright in parallel to the crankshaft, and the exhaust pipe has an upper end opened in an upper portion of the exhaust passage and a lower end supporting the cylinder block, and the exhaust manifold and the exhaust pipe are provided with a gap therebetween in a plan view acting as an exhaust collection space adapted to collect exhaust gas from the exhaust manifold.

5 Claims, 8 Drawing Sheets

(52) U.S. Cl.
CPC ..... *F01N 13/10* (2013.01); *F01N 13/105* (2013.01); *F01N 13/107* (2013.01); *F01N 2590/021* (2013.01)

(56) References Cited

U.S. PATENT DOCUMENTS

| | | | | | |
|---|---|---|---|---|---|
| 5,239,825 | A * | 8/1993 | Shibata | F01N 3/046 | 422/179 |
| 5,306,185 | A * | 4/1994 | Lassanske | B63H 20/245 | 440/89 H |
| 5,439,651 | A * | 8/1995 | Kato | F01N 3/021 | 422/179 |
| 5,743,774 | A * | 4/1998 | Adachi | B63H 20/245 | 440/89 H |
| 5,916,132 | A * | 6/1999 | Yoshida | B63H 20/245 | 422/170 |
| 7,954,314 | B1 * | 6/2011 | Bruestle | F01N 3/2839 | 60/302 |
| 2011/0223819 | A1 * | 9/2011 | Kazuta | B63H 21/32 | 440/89 B |

FOREIGN PATENT DOCUMENTS

| | | | | | |
|---|---|---|---|---|---|
| JP | 08-085493 | A | | 4/1996 | |
| JP | 09-195788 | A | | 7/1997 | |
| JP | 09195788 | A | * | 7/1997 | F01N 3/24 |
| JP | 2005-016526 | A | | 1/2005 | |
| JP | 2013-108355 | A | | 6/2013 | |
| JP | 2013-124592 | A | | 6/2013 | |

* cited by examiner

EXHAUST APPARATUS OF OUTBOARD MOTOR

CROSS REFERENCE TO RELATED APPLICATION

This application is a Continuation Application of PCT application No. PCT/JP2015/060468, filed on Apr. 2, 2015, entitled "Exhaust Apparatus of Outboard Motor", which in turn claims priority to Japanese Patent Application No. 2014-081045 and Japanese Patent Application No. 2014-081046, both filed on Apr. 10, 2014, both of which are incorporated herein by reference.

TECHNICAL FIELD

The present invention relates to an exhaust structure of an outboard motor, and more particularly, to an exhaust apparatus of an outboard motor equipped with a multi-cylinder engine.

BACKGROUND ART

Conventionally, there is provided an exhaust apparatus of an outboard motor equipped with a multi-cylinder four-stroke engine, and such exhaust apparatus includes: a first exhaust passage adapted to collect exhaust gas discharged through exhaust ports of cylinders in lower portion of a cylinder block of the engine and exhaust gas discharged through exhaust ports of cylinders in upper portion; and a second exhaust passage adapted to lead exhaust gas in the first exhaust passage with an upper opening being communicated with the first exhaust passage and a lower opening being communicated with an exhaust passage of an engine holder, in which the first exhaust passage and the second exhaust passage are provided separately by being arranged side by side, and a catalyst is placed in the second exhaust passage (Patent Documents 1 and 2).

Furthermore, there is also provided another conventional exhaust apparatus of an outboard motor equipped with a multi-cylinder four-stroke engine, and the exhaust apparatus includes: an exhaust collection unit adapted to collect exhaust gas from exhaust ports, and a spacer plate and a cover containing a catalyst, in which the exhaust collection unit and the spacer plate with the cover are arranged side by side in a width direction of an engine (Patent Document 3).

PRIOR ART DOCUMENT

Patent Document

Patent Document 1: Japanese Patent Laid-Open No. 2008-169707

Patent Document 2: Japanese Patent Laid-Open No. 2013-124594

Patent Document 3: Japanese Patent Laid-Open No. 2000-356123

SUMMARY OF THE INVENTION

Problem to be Solved by the Invention

However, in the exhaust apparatus of the outboard motor which are described in Patent Documents 1 and 2, since the first exhaust passage adapted to collect exhaust gas from the exhaust ports and the second exhaust passage containing a catalyst are provided separately by being arranged side by side, a structure of the exhaust apparatus becomes complicated, and the exhaust apparatus is made large in size.

Particularly, in the exhaust apparatus of the outboard motor described in Patent Document 3, since the exhaust collection unit adapted to collect exhaust gas from the exhaust ports and a spacer plate and a cover containing a catalyst are arranged side by side in the width direction of the engine, the engine protrudes in the width direction, resulting in an increase in size in the width direction of the outboard motor.

The present invention was conceived in consideration of the circumstances mentioned above, and an object thereof is to provide an exhaust apparatus of an outboard motor capable of providing a simple structure, downsizing the apparatus, and improving an engine power.

Means for Solving the Problem

In order to achieve the above object, the present invention provides, as an embodiment, an exhaust apparatus of an outboard motor equipped with a four-stroke engine which includes a cylinder block provided therein with a cylinder so as to extend in a horizontal direction, a cylinder head fixed to the cylinder block so as to cover the cylinder and form a combustion chamber in conjunction with the cylinder, a crankcase adapted to house a crankshaft so as to extend in a vertical direction, and an exhaust apparatus, in which the cylinder head is formed with an intake port and an exhaust port communicated with the combustion chamber, wherein the exhaust apparatus includes a plurality of cylinder units each equipped with the cylinder, the combustion chamber, the intake port, and the exhaust port which are arranged side by side in the vertical direction in the cylinder block and the cylinder head, an exhaust manifold is formed on one side of the cylinder block in a width direction of an outboard motor so as to be communicated with the exhaust ports of the plurality of cylinder units and extending in parallel to the crankshaft, an exhaust pipe having a cylindrical shape and connected to an exhaust passage of an engine holder is disposed in an exhaust passage of the exhaust manifold in a manner being erected upright in parallel to the crankshaft, and the exhaust pipe has an upper end opened in an upper portion of the exhaust passage and a lower end supporting the cylinder block, and the exhaust manifold and the exhaust pipe are provided with a gap therebetween in a plan view acting as an exhaust collection space adapted to collect exhaust gas from the exhaust manifold.

It may be desired that the exhaust pipe and the exhaust collection space are disposed in a back-and-forth direction each other along a cylinder axis of the four-stroke engine in planar view.

It may be desired that the exhaust manifold is provided with an exhaust manifold portion formed in the cylinder block and an exhaust cover covering an opening in the exhaust manifold portion which are joined to together, the exhaust manifold portion and the exhaust cover are provided to be separable along a section parallel to an axial direction of the crankshaft.

Furthermore, it may be desired that the four-stroke engine is a four-stroke V-type engine in which the cylinder block and the cylinder head are provided with a cylinder and a left bank extending diagonally left rearward, and with a cylinder and a right bank extending diagonally right rearward, and the exhaust manifold is installed outward of the left bank and the right bank in the width direction of an outboard motor and made up of a left exhaust manifold and a right exhaust manifold communicated, respectively, with the exhaust ports in the left bank and the right bank.

It may be further desired that a catalyst is disposed in an upper portion in the exhaust pipe and above the exhaust port of a lowermost cylinder in the cylinder block.

It may be further desired that the exhaust pipe is disposed in a manner of deflecting to a side opposite to openings of the exhaust ports communicated with the exhaust passage in the exhaust manifold, and the exhaust collection space adapted to collect exhaust gas from the exhaust ports is formed between the exhaust pipe and the openings of the exhaust ports.

Effects of the Invention

According to an outboard motor a equipped with a four-stroke engine, the gap is provided between the exhaust pipe and the inside of the exhaust passage of the exhaust manifold communicated with the exhaust ports of the plurality of cylinder units in a manner in which the exhaust pipe is disposed by being deflected to the side opposite to the openings of the exhaust ports, and accordingly, the exhaust collection space adapted to collect the exhaust gas from the exhaust ports can be provided between the exhaust pipe and the openings of the exhaust ports in the exhaust manifold. This arrangement makes it possible to simplify the structure of the exhaust apparatus compared to the structure according to conventional technique, in which the first exhaust passage portion and the second exhaust passage portion are provided separately by being arranged side by side, in which the first exhaust passage portion collects the exhaust gas discharged through the exhaust ports of the cylinders in the lower portion of the cylinder block of the engine and the exhaust gas discharged through the exhaust ports of the cylinders in the upper portion while the second exhaust passage portion leads the exhaust gas in the first exhaust passage portion with the upper opening being communicated with the first exhaust passage portion and the lower opening being communicated with the exhaust passage of the engine holder.

In addition, since the exhaust pipe is made of pipe material, a thin-walled structure can be realized, thereby downsizing the exhaust apparatus in comparison with a case in which the first and second exhaust passage portions are cast-molded such as in the conventional technique.

Furthermore, in the exhaust manifold, since the exhaust pipe is placed in a manner of being deflected to the side opposite to the openings of the exhaust ports, the exhaust collection spacer adapted to collect the exhaust gas from the exhaust ports can be provided between the exhaust pipe and the openings of the exhaust ports. This arrangement makes it possible to provide larger distances between the openings of the exhaust ports and the exhaust pipe, thereby reducing the exhaust resistance and improving improve the engine power.

The further operation and effects according to the structure of the embodiment of the present invention will become more apparent from the following description with reference to the accompanying drawings.

EMBODIMENT FOR CARRYING OUT THE INVENTION

An embodiment of the present invention will be described below with reference to the accompanying drawings.

Figure 1:
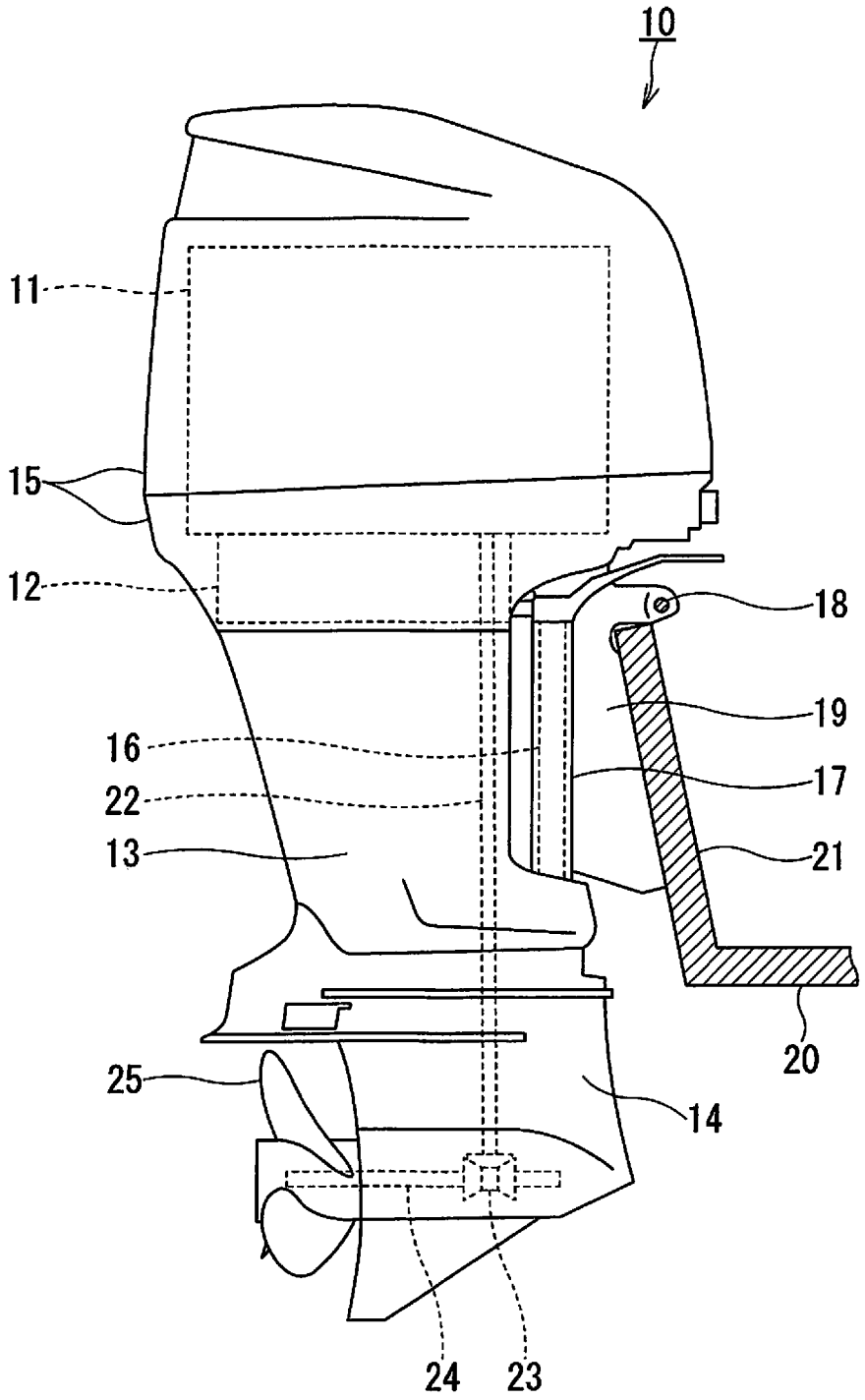
FIG. 1 is a right side view illustrating an outboard motor to which an exhaust apparatus of an outboard motor according to an embodiment of the present invention is applied.

FIG. 1 is a right side view showing an outboard motor equipped with an outboard motor exhaust apparatus (exhaust structure) according to an embodiment of the present invention. An outboard motor 10 shown in FIG. 1 includes an engine holder 12 on which an engine 11 is mounted. A drive shaft housing 13 and a gear case 14 are installed under the engine holder 12 in order. Further, the engine 11 and the engine holder 12 in FIG. 1 are covered with a vertically dividable engine cover 15.

A pilot shaft 16 is pivotally supported on a swivel bracket 17, and hence, the outboard motor 10 is pivotally supported in a horizontal direction, the swivel bracket 17 is supported pivotally with respect to a clamp bracket 19 in a vertical direction via a swivel shaft 18, and the clamp bracket 19 is mounted to a stern (transom) 21 of a hull 20. According to such arrangement, the outboard motor 10 is mounted on the hull 20 swingably in the horizontal direction (steering direction) and the vertical direction (i.e., trim and tilt direction).

According to the outboard motor 10 having the configuration mentioned above, when the engine 11 operates, a driving force of the engine 11 is transmitted to the drive shaft 22 arranged in a substantially vertical direction in the drive shaft housing 13 and a gear case 14, and the driving force is then transmitted to a propeller 25 through a shift mechanism 23 and propeller shaft 24 disposed in the gear case 14. The propeller 25 is rotated in a normal or reverse direction and the hull 20 is thereby moved forward or backward.

Figure 2:
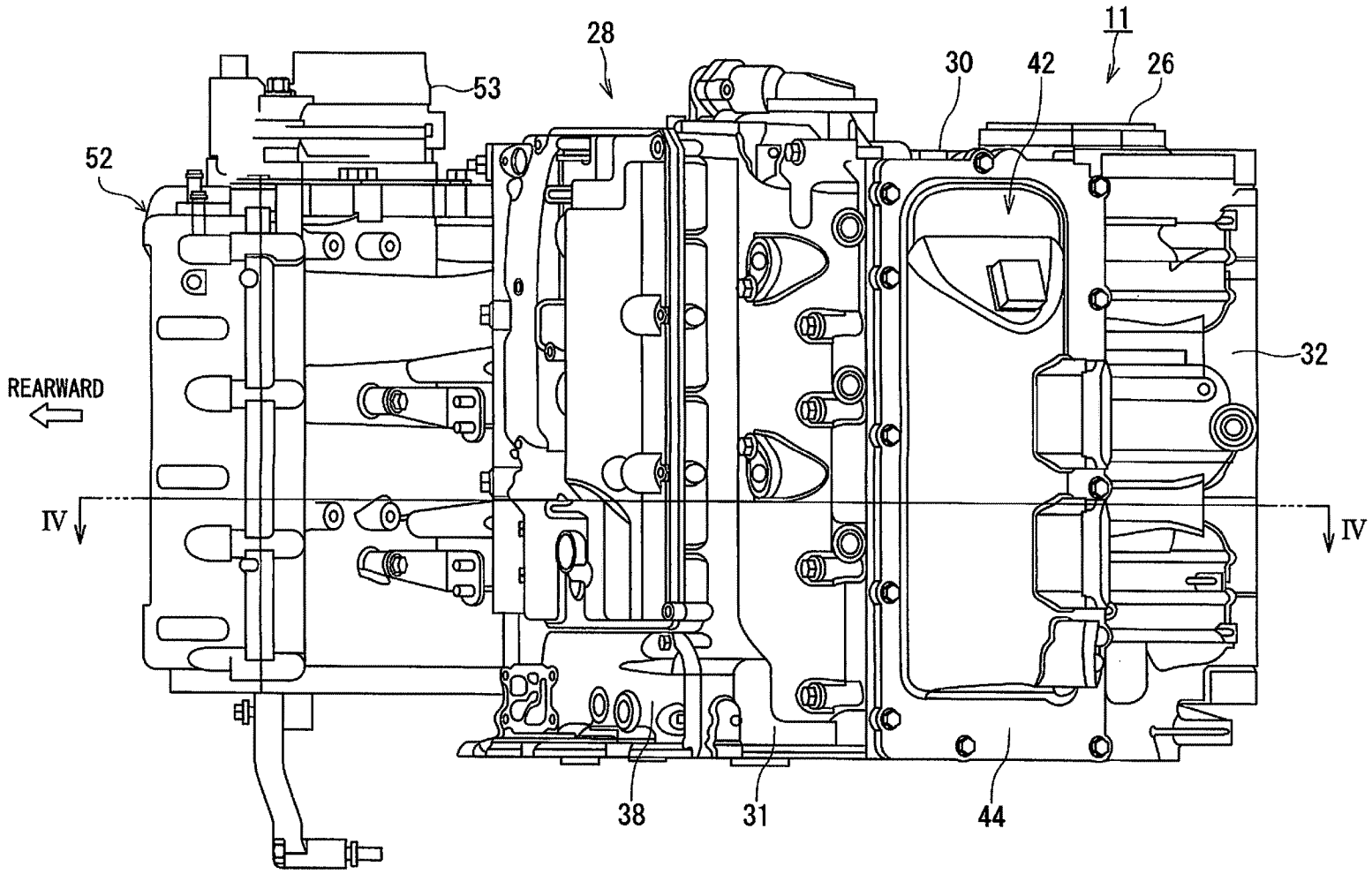
FIG. 2 is a right side view showing an engine of FIG. 1.
Figure 3:
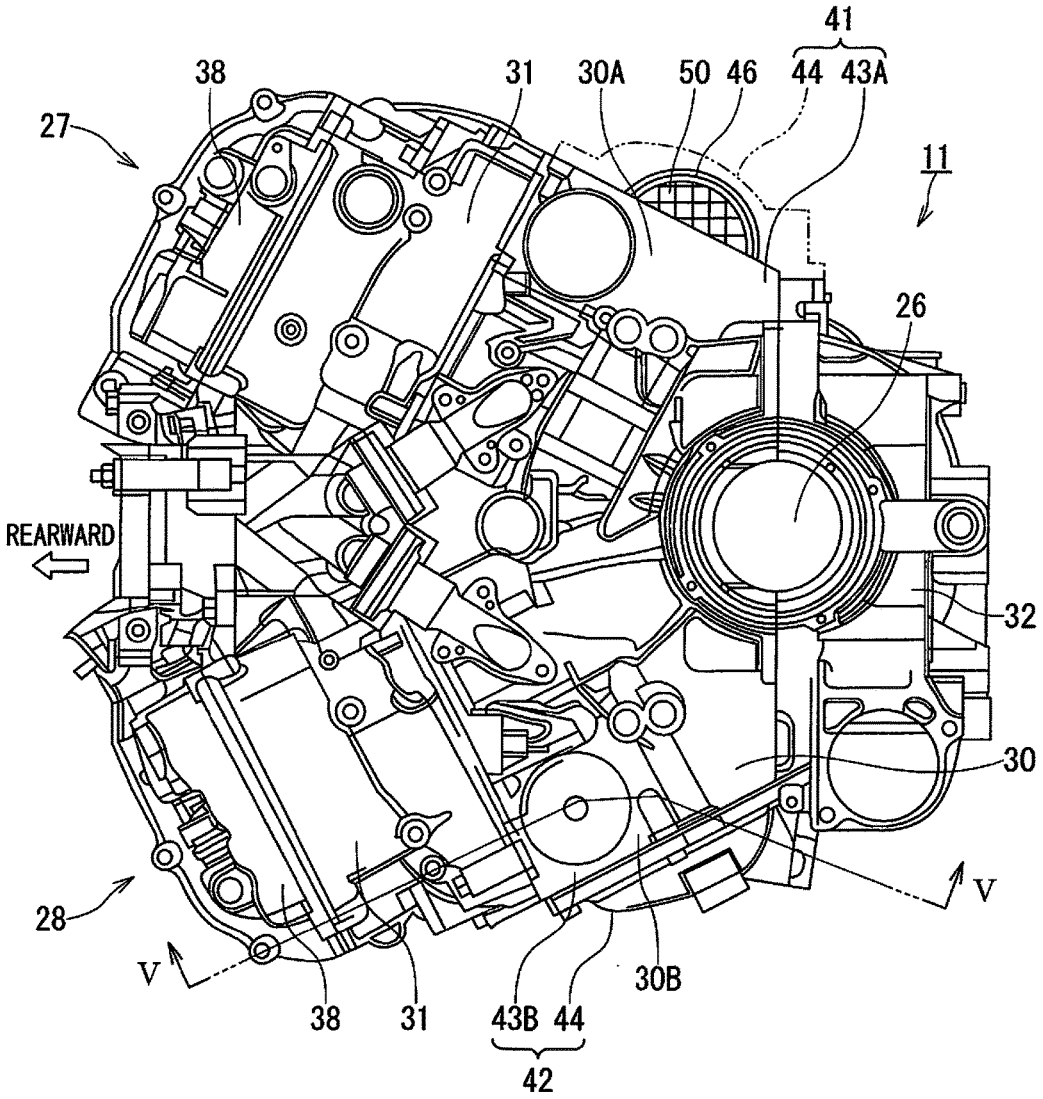
FIG. 3 is a plan view showing the engine of FIG. 1.

As shown in FIGS. 2 and 3, the engine of the present embodiment is a four-stroke V-type engine which includes a crankshaft 26 extending in the vertical direction, a left bank 27 extending diagonally left rearward, and a right bank 28 extending diagonally right rearward. In the four-stroke V engine, the left bank 27 is made up of a cylinder head 31 and a cylinder head cover 38 disposed in sequence behind a left bank portion 30A of a cylinder block 30, the right bank 28 is made up of a cylinder head 31 and a cylinder head cover 38 disposed in sequence behind a right bank portion 30B of the cylinder block 30, and a crankcase 32 is disposed in front of the cylinder block.

Figure 4:
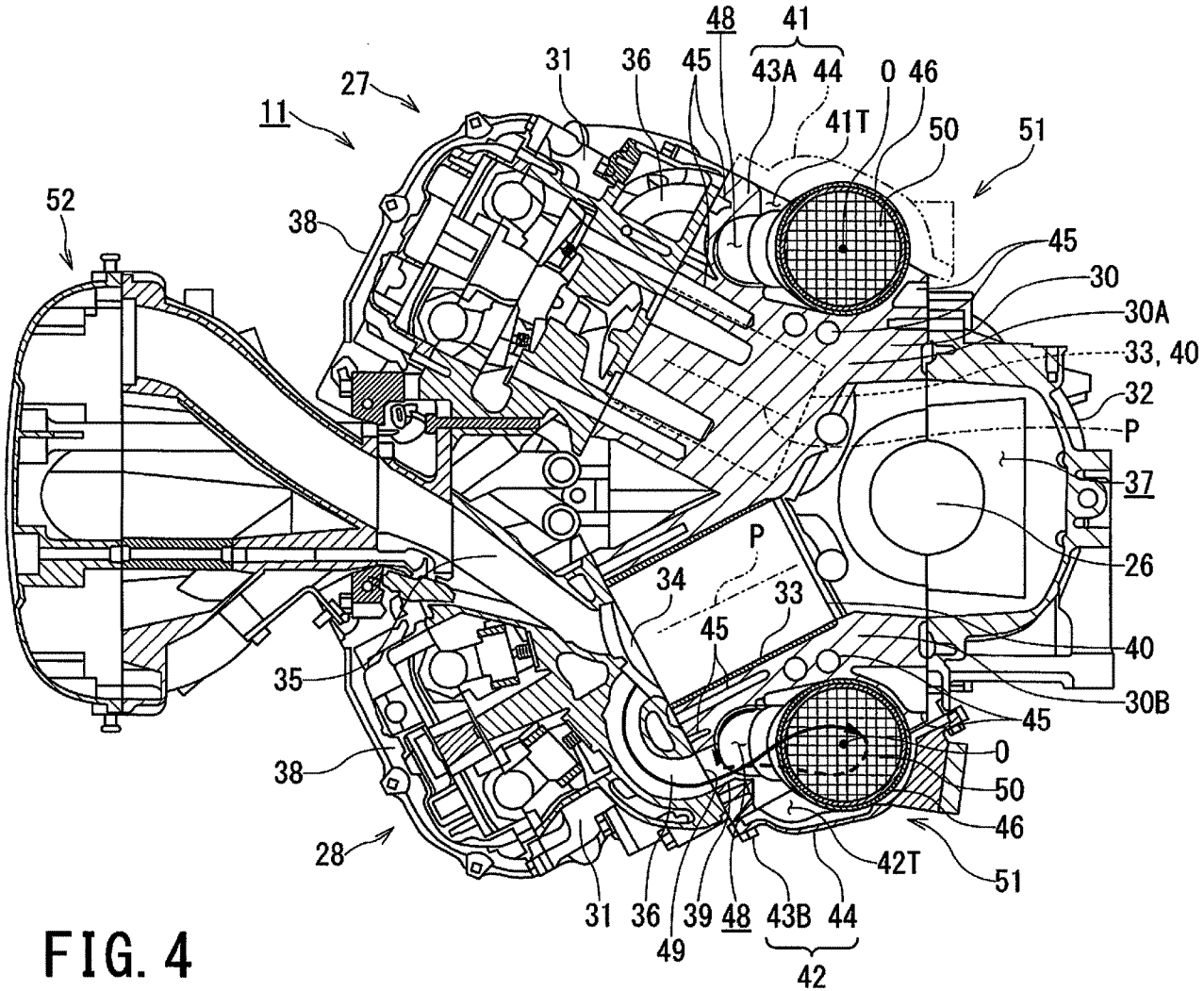
FIG. 4 is a sectional view taken along the line IV-IV of FIG. 2.

As shown in FIG. 4, which is a sectional view taken along the line IV-IV of FIG. 2, cylinders 33 are provided in a horizontal direction inside the left bank portion 30A of the cylinder block 30 so as to extend diagonally left rearward. Cylinders 33 are also provided in a horizontal direction inside the right bank portion 30B of the cylinder block 30 so as to extend diagonally right rearward. Further, pistons, not shown, are disposed to be reciprocal in the cylinders 33, and the pistons are coupled to the crankshaft 26 via connecting rods, not shown.

Along cylinder axes P of the cylinders 33 in the left bank portion 30A and right bank portion 30B of the cylinder block 30, the cylinder heads 31 are fixed, respectively, to the left bank portion 30A and right bank portion 30B so as to cover the cylinders 33 to thereby form combustion chambers 34 in conjunction with respective cylinders 33 in the left bank portion 30A and right bank portion 30B.

Further, intake ports 35 communicated with the combustion chambers 34 in the left bank portion 30A and right bank portion 30B of the cylinder block 30 are formed in the cylinder heads 31 inwardly of the cylinder axes P of the cylinders 33 in a width direction of the outboard motor. Furthermore, exhaust ports 36 communicated with the combustion chambers 34 are formed in the cylinder heads 31 outwardly of the cylinder axes P of the cylinders 33 in the width direction of the outboard motor.

Figure 5:
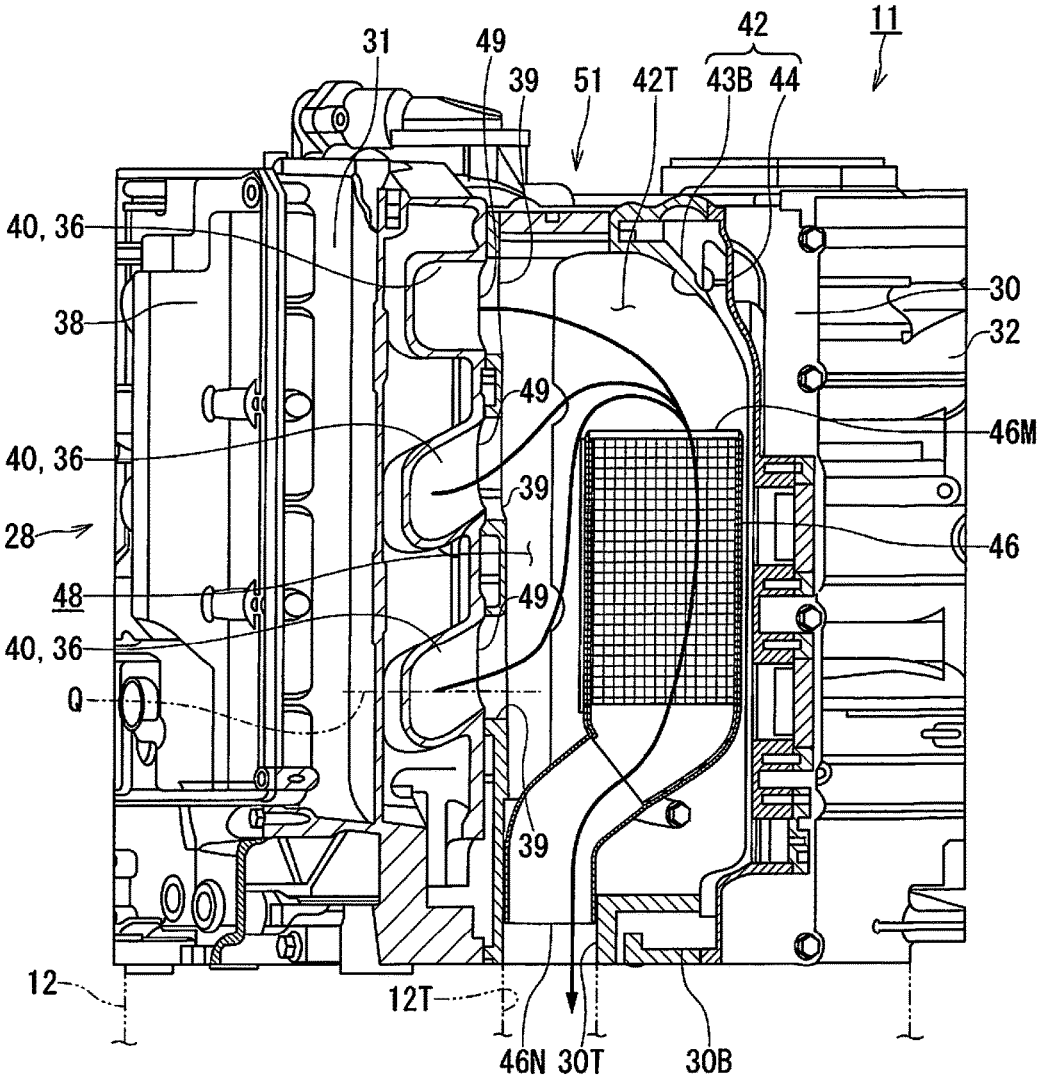
FIG. 5 is a sectional view taken along the line V-V of FIG. 3.
Figure 6:
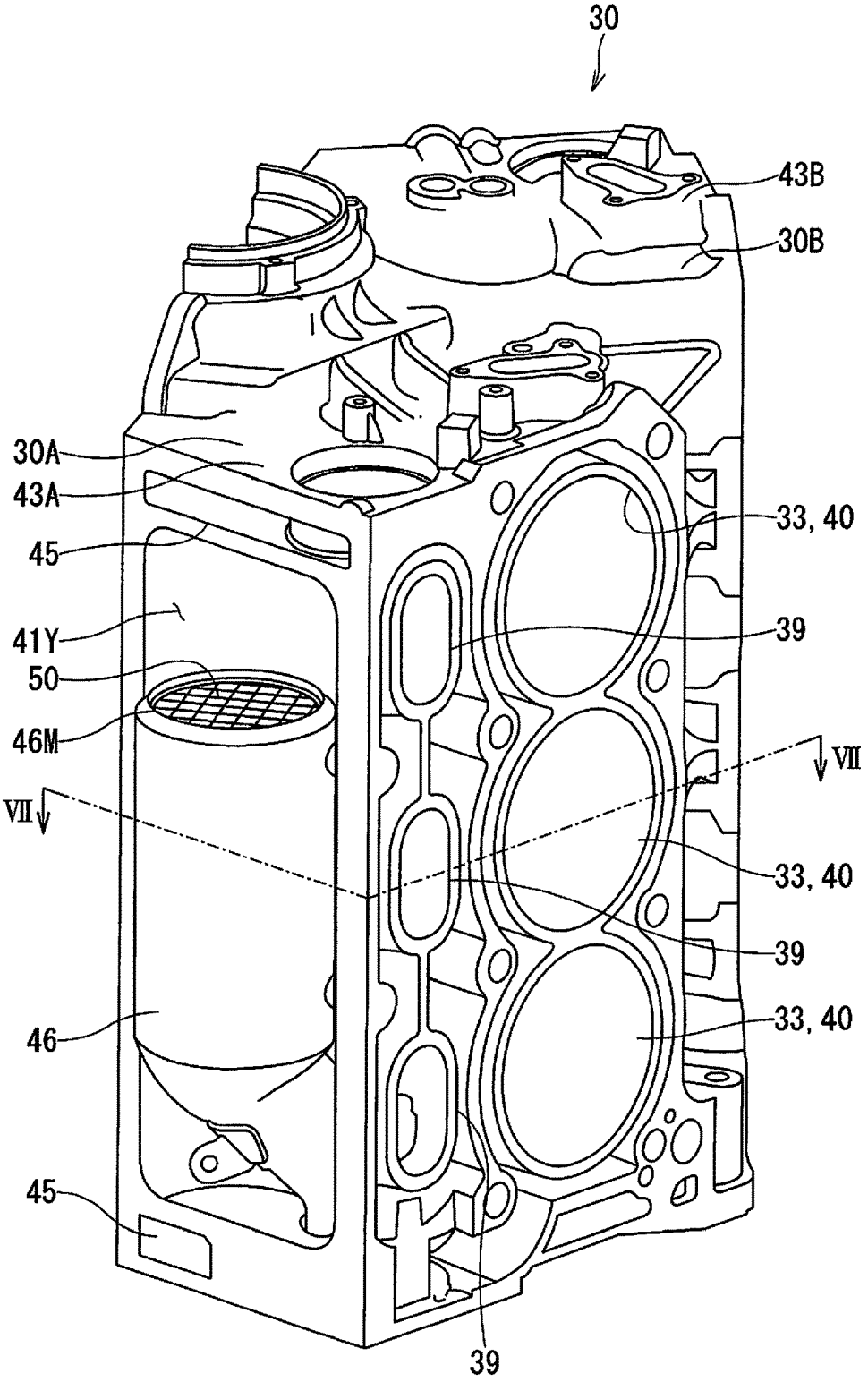
FIG. 6 is a perspective view showing a cylinder block in FIGS. 3 and 4.

The crankcase 32 is joined to the cylinder block 30 to thereby form a crank chamber 37 in conjunction with the cylinder block 30, and the crankshaft 26 is housed in the crank chamber 37. Further, in each of the above-mentioned left bank 27 and right bank 28, a plurality of cylinder units 40, each of which is equipped with a cylinder 33, a combustion chamber 34, an intake port 35, and an exhaust port 36, are arranged side by side in a vertical direction as shown in FIGS. 5 and 6. According to the present embodiment, three cylinder units 40 are arranged side by side in the vertical direction in each of the right bank 28 and the left bank 27 so as to constitute the engine 11 as a V-type six-cylinder four-stroke engine.

As shown in FIGS. 2, 3 and 4, an right exhaust manifold 42 is mounted on an outer side of the right bank 28 in the width direction of the outboard motor so as to extend in the vertical direction in parallel to the crankshaft 26 to be communicated with the exhaust ports 36 of the plural cylinder units 40 installed in the right bank 28. Likely, a left exhaust manifold 41 is mounted on an outer side of the left bank 27 in the width direction of the outboard motor so as to extend in the vertical direction in parallel to the crankshaft 26 to be communicated with the exhaust ports 36 of the plural cylinder units 40 installed in the left bank 27.

The right exhaust manifold 42 is, as shown in FIGS. 3 to 5, made up of a right exhaust manifold portion 43B formed in the right bank portion 30B of the cylinder block 30 and an exhaust cover 44 covering an opening of the right exhaust manifold portion 43B. The right exhaust manifold portion 43B and the exhaust cover 44 are joined together so as to be separable along a section parallel to the crankshaft 26. On the other hand, as shown in FIGS. 3, 4, 6 and 7, the left exhaust manifold 41 is made up of a left exhaust manifold portion 43A formed in the left bank portion 30A of the cylinder block 30 and an exhaust cover 44 covering an opening of the left exhaust manifold portion 43A. The left exhaust manifold portion 43A and exhaust cover 44 are joined together and to be separable along a section parallel to the crankshaft 26.

Since the right exhaust manifold portion 43B and exhaust cover 44 are joined together, an exhaust passage 42T of the right exhaust manifold 42 is formed so as to be communicated with the exhaust ports 36 of the plural cylinder units 40 in the right bank 28 via communicating holes 39 in the right bank portion 30B. In the like manner, since the left exhaust manifold portion 43A and exhaust cover 44 are joined together, an exhaust passage 41T of the left exhaust manifold 41 is formed so as to be communicated with the exhaust ports 36 of the plural cylinder units 40 in the left bank 27 via communicating holes 39 in the left bank portion 30A. Further, as shown in FIG. 2, a vertical dimension of the exhaust cover 44 is set equal to a vertical dimension of the cylinder block 30.

As shown in FIG. 4, in the right exhaust manifold portion 43B of the cylinder block 30, a water jacket 45 is formed around the exhaust passage 42T of the right exhaust manifold 42 so as to cool the right exhaust manifold portion 43B. In the like manner, in the left exhaust manifold portion 43A of the cylinder block 30, a water jacket 45 is formed around the exhaust passage 41T of the left exhaust manifold 41 so as to cool the left exhaust manifold portion 43A.

As shown in FIGS. 4 to 6, in each of the exhaust passage 42T of the right exhaust manifold 42 and the exhaust passage 41T of the left exhaust manifold 41, an tubular exhaust pipe (for example, cylindrical pipe) made of a pipe member is provided to be upright in parallel to the crankshaft 26. The exhaust pipe 46 has an upper end 46M opened to an upper portion of the exhaust passage 42T or 41T, for example, to a neighborhood of a boundary between an uppermost cylinder unit 40 in the right bank 28 or left bank 27 and a cylinder unit 40 adjacent to the uppermost cylinder unit 40. Furthermore, a lower end 46N of the exhaust pipe 46 is fitted in an exhaust passage 30T formed in a lower end portion of the cylinder block 30, and the exhaust passage 30T is connected to an exhaust passage 12T of the engine holder 12 which supports the cylinder head 31, the crankcase 32, and the like.

Figure 7:
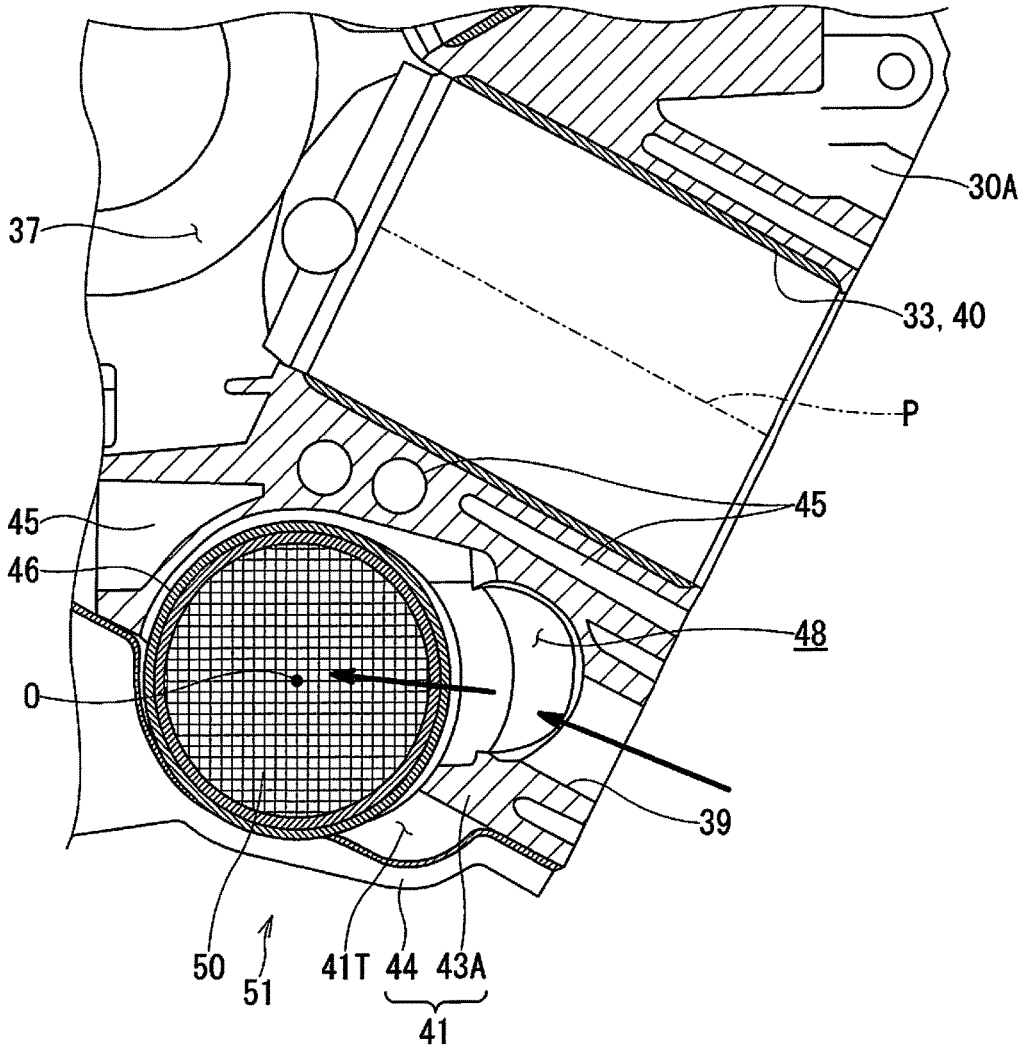
FIG. 7 is a sectional view taken along the line VII-VII of FIG. 6.

In the plan views shown in FIGS. 4 and 7, a center "O" of the exhaust pipe 46 is positioned closer to the cylinders 33 than to a mating surface between the right exhaust manifold portion 43B in the right bank portion 30B of the cylinder block 30 and the exhaust cover 44, or a mating surface between the left exhaust manifold portion 43A in the left bank portion 30A of the cylinder block 30 and the exhaust cover 44, and the most part of the exhaust pipe 46 is positioned within the right exhaust manifold portion 43B or the left exhaust manifold portion 43A.

As shown in FIGS. 4 to 7, a gap 48 is formed between the exhaust pipe 46 and each of the right exhaust manifold 42 and the left exhaust manifold 41. That is, in the exhaust passage 42T of the right exhaust manifold 42 and the exhaust passage 41T of the left exhaust manifold 41, the exhaust pipes 46 are disposed respectively by deflecting to the side (front side) opposite to the openings 49 of the exhaust ports 36 which are communicated, respectively, with the exhaust passages 42T and 41T. According to such arrangement, the gap 48 is formed between the exhaust pipe 46 and each of the right exhaust manifold 42 and the left exhaust manifold 41. In the plan views of FIGS. 4 and 7, the gap 48 and the exhaust pipe 46 are provided one behind the other along each of the cylinder axes P of the cylinders 33, and in the present embodiment, the gap 48 is located behind the exhaust pipe 46.

In each of the exhaust passage 42T of the right exhaust manifold 42 and exhaust passage 41T of the left exhaust manifold 41, the gap 48 is formed between the exhaust pipe 46 and the openings 49 and communicating holes 39 of the plural exhaust ports 36. The gap 48 functions as exhaust collection space adapted to collect the exhaust gas from the exhaust ports 36. The exhaust gas from the plural exhaust ports 36 communicated with the exhaust passage 42T of the right exhaust manifold 42 and the exhaust passage 41T of the left exhaust manifold 41 is collected in the gaps 48 serving as exhaust collection space, and the collected exhaust gas flows into the exhaust pipe 46 from the upper end 46M thereof.

In each of the exhaust pipes 46, a catalyst 50 is provided in an upper portion of the exhaust pipe 46 and above a center line "Q" (FIG. 5) of the exhaust port 36 in a lowermost cylinder unit 40 in the right bank 28 or the left bank 27. The catalyst 50 comes into contact with the exhaust gas from the engine 11 to thereby chemically change harmful substances such as carbon dioxide, hydrocarbon, and nitrogen oxides contained in the exhaust gas into carbon dioxide, nitrogen, or the like through an oxidation-reduction reaction to thereby purify the exhaust gas. The catalyst 50 can be attached or detached solely or together with the exhaust pipe 46 from the right exhaust manifold portion 43B or the left exhaust manifold portion 43A.

An exhaust apparatus 51 of the engine 11 is made up of the left exhaust manifold 41, the right exhaust manifold 42, exhaust pipes 46, and the catalyst 50, which are described above. Further, reference numeral 52 in FIGS. 2 and 4 denotes an intake manifold adapted to supply fuel-air mixture to the combustion chambers 34 of the engine 11 and equipped with a throttle body 53.

As indicated by arrows in FIGS. 4, 5, 7 and 8, the exhaust gas generated in the combustion chambers 34 of the plural cylinder units 40 in the right bank 28 of the engine 11 passes through the exhaust ports 36 of the cylinder units 40 in the right bank 28 and gets collected in the exhaust collection space (i.e., gap 48) in the exhaust passage 42T of the right exhaust manifold 42. Then, a part of the exhaust gas moves up, flows into the upper end 46M of the exhaust pipe 46 disposed in the right exhaust manifold 42, and gets purified while passing through the catalyst 50 in the exhaust pipe 46. The exhaust gas purified by the catalyst 50 is then discharged into an exhaust expansion chamber, not shown, of the drive shaft housing 13 (FIG. 1) by passing through the exhaust passage 30T in the cylinder block 30 and the exhaust passage 12T of the engine holder 12.

On the other hand, the exhaust gas generated in the combustion chambers 34 of the plural cylinder units 40 in the left bank 27 of the engine 11 passes through the exhaust ports 36 in the cylinder units 40 on the left bank 27 and gets collected in the exhaust collection space (i.e., gap 48) in the exhaust passage 41T of the left exhaust manifold 41. Then a part of the exhaust gas moves up, flows into the upper end 46M of the exhaust pipe 46 disposed in the left exhaust manifold 41, and gets purified while passing through the catalyst 50 in the exhaust pipe 46. The exhaust gas purified by the catalyst 50 is then discharged into the exhaust expansion chamber of the drive shaft housing 13 by passing through the exhaust passage 30T in the cylinder block 30 and the exhaust passage 12T in the engine holder 12.

The exhaust gas reaches the exhaust expansion chamber of the drive shaft housing 13 shown in FIG. 1 is discharged into water through a central portion of the propeller 25 through an exhaust passage, not shown, formed around the propeller shaft 24 in the gear case 14.

According to the outboard motor exhaust apparatus (exhaust structure) of the present invention, the following advantageous effects can (1) to (11) can be achieved.

(1) As shown in FIG. 4, the exhaust pipes 46 are disposed, respectively, in the exhaust passage 41T of the left exhaust manifold 41 and the exhaust passage 42T of the right exhaust manifold 42, which are communicated with the exhaust ports 36 of the plural cylinder units 40 in the left bank 27 and right bank 28, and in addition, the gaps 48 functioning as exhaust collection space so as to collect the exhaust gas are provided between the exhaust pipes 46 and the left and right exhaust manifolds 41 and 42. According to such structures, it makes possible to realize a compact structure of the exhaust apparatus 51 of the engine 11 compared to the conventional structures described in Patent Documents 1 and 2. That is, in the conventional structures, the first exhaust passage portion and second exhaust passage portion are provided separately in a manner such that the first exhaust passage portion collects the exhaust gas discharged through the exhaust ports of the cylinders in the lower portion of the cylinder block and the exhaust gas discharged through the exhaust ports of the cylinders in the upper portion, and the second exhaust passage portion leads the exhaust gas in the first exhaust passage portion in a state that the upper opening is communicated with the first exhaust passage portion and that the lower opening is communicated with the exhaust passage of the engine holder.

(2) Since the exhaust pipe 46 is made of pipe material, a thin-walled structure can be produced, thus the exhaust apparatus 51 being downsized in comparison with a case in which the first and second exhaust passage portions are cast-molded as described in Patent Documents 1 and 2.

(3) In each of the left exhaust manifold 41 and right exhaust manifold 42, since the exhaust pipe 46 is disposed by deflecting to the side opposite to the openings 49 of the exhaust ports 36 in the cylinder head 31, the gap 48 functioning as exhaust collection space adapted to collect the exhaust gas from the exhaust ports 36 is provided between the exhaust pipe 46 and the openings 49 and communicating holes 39 of the exhaust ports 36. This makes it possible to provide larger distances between the openings of the exhaust ports 36 and the exhaust pipe 46, resulting in reduced exhaust resistance, thereby improving the power of the engine 11.

(4) The left exhaust manifold 41 is made up of the left exhaust manifold portion 43A formed in the left bank portion 30A of the cylinder block 30 and the exhaust cover 44 for covering the opening of the left exhaust manifold portion 43A in a manner such that the left exhaust manifold portion 43A and exhaust cover 44 are joined together. Furthermore, the right exhaust manifold 42 is made up of the right exhaust manifold portion 43B formed in the right bank portion 30B of the cylinder block 30 and the exhaust cover 44 for covering the opening of the right exhaust manifold portion 43B in a manner such that the right exhaust manifold portion 43B and the exhaust cover 44 are joined together. In addition, the exhaust pipes 46 containing the catalyst 50 are housed in the left exhaust manifold 41 and right exhaust manifold 42. As described above, since the parts of the left exhaust manifold 41 and the right exhaust manifold 42 housing the exhaust pipes 46 are formed in the cylinder block 30, the left exhaust manifold 41 and right exhaust manifold 42 do not protrude outward in the width direction of the outboard motor. This arrangement makes the engine 11 compact.

Furthermore, since the left exhaust manifold 41 is formed to be separable into the left exhaust manifold portion 43A and the exhaust cover 44, and the right exhaust manifold 42 is also formed to be separable into the right exhaust manifold portion 43B and the exhaust cover 44, the exhaust passage 41T of the left exhaust manifold 41 and the exhaust passage 42T of the right exhaust manifold 42 can be formed easily, resulting in cost reduction.

(5) In the left exhaust manifold 41 and right exhaust manifold 42, the respective exhaust pipes 46 containing the catalyst 50 and the gaps 48 functioning as the exhaust collection space are arranged one behind the other in the plan view along the cylinder axes P of the cylinders 33 on the left bank 27 and the right bank 28. This arrangement makes it possible to reduce the dimension of the engine 11 in the width direction, and to thereby make the engine 11 compact compared to the conventional structure described in Patent Document 3, in which the exhaust collection unit for collecting the exhaust gas from the exhaust ports and the spacer plate and the cover containing the catalyst are arranged side by side in the width direction of the engine.

Figure 8:
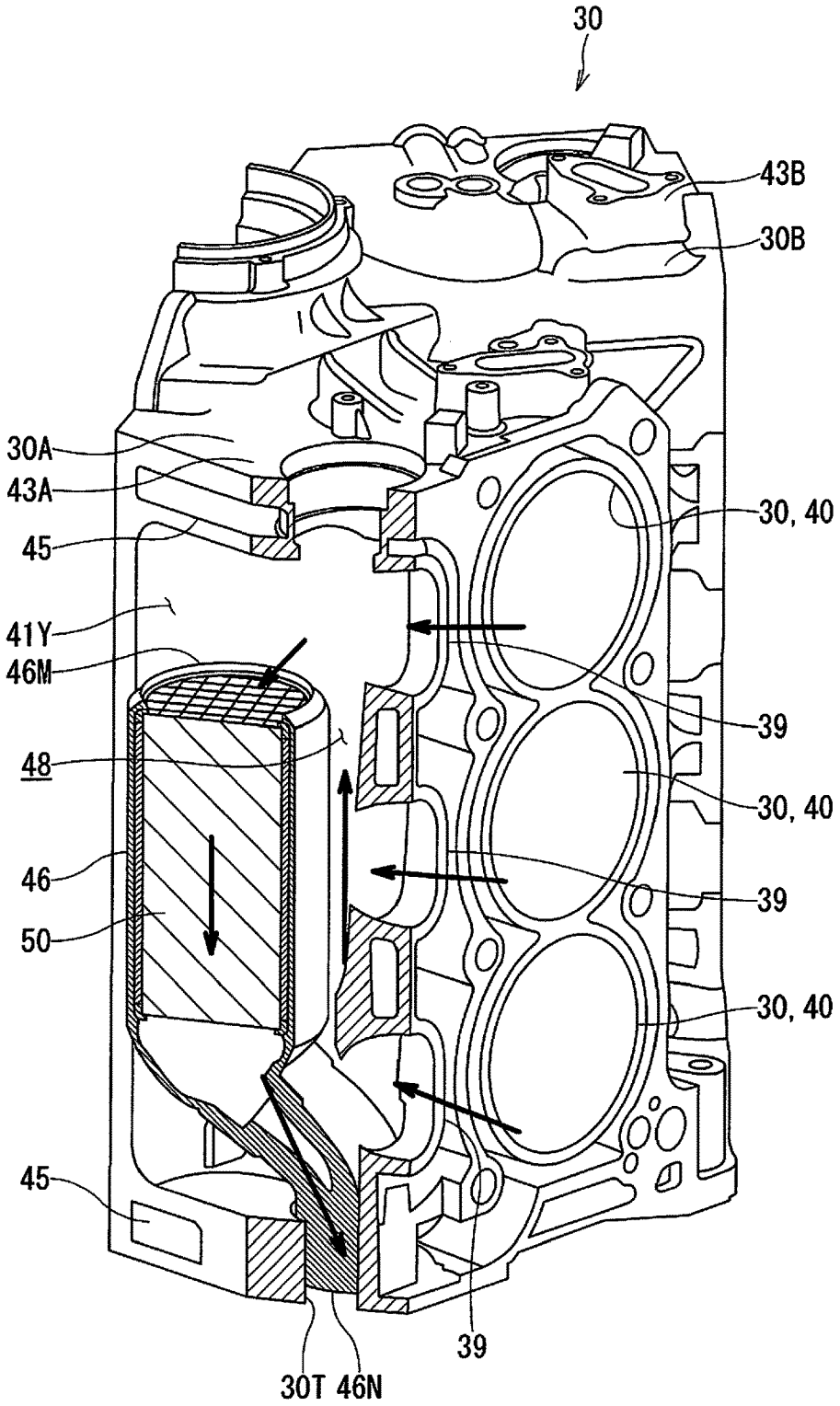
FIG. 8 is a perspective view, partially cut-away, of FIG. 6.

(6) Still furthermore, as shown in FIGS. 4, 5, and 8, the upper ends 46M of the exhaust pipes 46 disposed, respectively, in the exhaust passage 41T of the left exhaust manifold 41 and the exhaust passage 42T of the right exhaust manifold 42 open to the upper portions of the exhaust passage 41T and exhaust passage 42T, for example, to the neighborhoods of the boundaries between the uppermost cylinder units 40 in the right bank 28 and the left bank 27 and the cylinder units 40 adjacent to these uppermost cylinder units 40. This arrangement makes it possible to prevent water flowing back through an exhaust passage in the gear case 14, the exhaust expansion chamber of the drive shaft housing 13, the exhaust passage 12T in the engine holder 12, and the like from overflowing from the upper ends 46M of the exhaust pipes 46 and flowing into the exhaust passage 41T and exhaust passage 42T when the engine 11 stops.

(7) Still furthermore, since the catalyst 50 is disposed in the upper portions in the exhaust pipes 46 and above the exhaust ports 36 of the lowermost cylinders 40 in the left bank portion 30A and the right bank portion 30B of the cylinder block 30, at the time when the engine 11 stops, it is possible to prevent the catalyst 50 from getting wet with the water flowing back through the exhaust passage in the gear case 14, the exhaust expansion chamber of the drive shaft housing 13, the exhaust passage 12T in the engine holder 12, and the like. This arrangement ensures the durability and the exhaust purification performance of the catalyst 50.

(8) Still furthermore, in the exhaust passage 41T of the left exhaust manifold 41 and the exhaust passage 42T of the right exhaust manifold 42, the exhaust pipes 46 are disposed by deflecting to the side opposite to the openings 49 of the exhaust ports 36 communicated with the exhaust passage 41T and 42T, respectively. Accordingly, the gaps 48 functioning as the exhaust collection space are provided between the left exhaust manifold 41 and the exhaust pipe 46 and between the right exhaust manifold 42 and the exhaust pipe 46. Thus, the exhaust gas discharged from the exhaust ports 36 is collected in the gaps 48 (exhaust collection space), and then, flows into the catalyst 50 in the exhaust pipes 46 after damping the exhaust pulsation, thereby suppressing the instantaneous flow velocity of the exhaust gas flowing through the catalyst 50, thus making it possible to improve the exhaust purification efficiency.

(9) Still furthermore, since the exhaust pipe 46 containing the catalyst 50 are disposed respectively in the exhaust passage 41T of the left exhaust manifold 41 and the exhaust passage 42T of the right exhaust manifold 42 communicated with the exhaust ports 36 in the cylinder heads 31, the temperature of the catalyst 50 can be raised quickly to a reaction temperature by the heat of the exhaust gas discharged from the exhaust ports 36. Thus, the exhaust gas can be purified by the catalyst 50 soon just after the startup of the engine 11.

(10) Still furthermore, the exhaust pipes 46, which are disposed respectively in the exhaust passage 41T of the left exhaust manifold 41 and the exhaust passage 42T of the right exhaust manifold 42, contain the catalyst 50, and the respective upper ends 46M of these pipes 46 open in the upper portions of the exhaust passages 41T and 42T. Accordingly, the most part of the exhaust gas in the exhaust passages 41T and 42T flows upward and into the catalyst 50 from the upper ends 46M of the exhaust pipes 46. Thus, the condensed water generated during the cooling of the engine 11 is vaporized by the heat of the exhaust gas flowing upward and then flows into the catalyst 50 as described above, making it possible to prevent thermal degradation of the catalyst 50.

(11) Still furthermore, the water jackets 45 are formed respectively around the exhaust passages 41T and 42T in the left exhaust manifold portion 43A of the cylinder block 30 forming the exhaust passage 41T of the left exhaust manifold 41 and the right exhaust manifold portion 43B of the cylinder block 30 forming the exhaust passage 42T of the right exhaust manifold 42, and the left exhaust manifold portion 43A and the right exhaust manifold portion 43B can be hence cooled. As a result, the cylinders 33 and the combustion chambers 34 formed in the left bank portion 30A and the right bank portion 30B of the cylinder block 30 are not heated locally by the heat in the exhaust passages 41T and 42T, and accordingly, it becomes possible to prevent uneven distribution of thermal strain in the cylinders 33 and combustion chambers 34 from causing.

It is further to be noted that the embodiment of the present invention described above is presented only by way of example, and not intended to limit the scope of the invention. The embodiment can be implemented in various other modes, and various omissions, replacements, and modifications may be made without departing from the spirit of the present invention.

For example, in the present embodiment described above, although a case in which the engine 11 is a V6 four-stroke type is described, the engine 11 may be an in-line multi-cylinder four-stroke type. In such in-line multi-cylinder four-stroke engine, the exhaust manifold 41 or 42 will be installed on one side of the cylinder block in the width direction of the outboard motor, the exhaust manifold will be made up of the exhaust manifold portion 43A or 43B and the exhaust cover 44 formed in the cylinder block in the manner in which the exhaust manifold portion and the exhaust cover 44 are joined together, and the exhaust pipe 46 containing the catalyst 50 is provided so as to stand upright in the vertical direction.

REFERENCE NUMERAL

11 - - - engine, 12 - - - engine holder, 26 - - - crankshaft, 27 - - - left bank, 28 - - - right bank, 30 - - - cylinder block, 31 - - - cylinder head, 32 - - - crankcase, 33 - - - cylinder, 34 - - - combustion chamber, 35 - - - intake port, 36 - - - exhaust port, 40 - - - cylinder, 41 - - - left exhaust manifold, 42 - - - right exhaust manifold, 41T, 42T - - - exhaust passage, 43A - - - left exhaust manifold portion, 43B - - - right exhaust manifold portion, 44 - - - exhaust cover, 46 - - - exhaust pipe, 46M - - - upper end of exhaust pipe, 46N - - - lower end of exhaust pipe, 48 - - - gap, 50 - - - catalyst, 51 - - - exhaust apparatus.

The invention claimed is:

1. An exhaust apparatus of a four stroke engine of an outboard motor, wherein the four-stroke engine includes a cylinder block, a cylinder head, a crank case, and the exhaust apparatus, wherein the cylinder block is provided therein with a cylinder that extends in a horizontal direction, wherein the cylinder head is fixed to the cylinder block so as to cover the cylinder, forms a combustion chamber in conjunction with the cylinder, and is formed with an intake port and an exhaust port in communication with the combustion chamber, wherein the crankcase is adapted to house a crankshaft that extends in a vertical direction, and wherein, in the cylinder block and the cylinder head, a plurality of cylinder units, each equipped with including the cylinder, the combustion chamber, the intake port, and the exhaust port, are arranged side by side in the vertical direction, the exhaust apparatus comprising:

an exhaust manifold formed on one side of the cylinder block in a width direction of the outboard motor so as to be in communication with the exhaust ports of the plurality of cylinder units and to extend in parallel with the crankshaft; and an exhaust pipe having a cylindrical shape, dispose in an exhaust passage of the exhaust manifold so as to be erected upright in parallel with the crankshaft, and having an upper end and a lower end, the upper end being opened in an upper portion of the exhaust passage, the lower end being connected to an exhaust passage of an engine holder that supports the cylinder block, wherein the exhaust manifold and the exhaust pipe are provided with a gap therebetween in a planar view acting as an exhaust collection space adapted to collect exhaust gas from the exhaust manifold, and a catalyst is disposed in an upper portion in the exhaust pipe and above the exhaust port of a lowermost cylinder in the cylinder block.

2. The exhaust apparatus of claim 1, wherein the exhaust pipe and the exhaust collection space are disposed relative to each other along a cylinder axis of the four-stroke engine in planar view.

3. The exhaust apparatus of claim 1, wherein the exhaust manifold is provided with an exhaust manifold portion formed in the cylinder block and an exhaust cover covering an opening in the exhaust manifold portion which are joined together, wherein the exhaust manifold portion and the exhaust cover are separable along a section parallel to an axial direction of the crankshaft.

4. The exhaust apparatus of claim 1, wherein the four-stroke engine is a four-stroke V-type engine in which the cylinder block and the cylinder head are provided with a cylinder and a left bank extending diagonally left rearward, and with a cylinder and a right bank extending diagonally right rearward, and a left exhaust manifold is installed outward of the left bank in the width direction of the outboard motor, and a right exhaust manifold is installed outward of the right bank in the width direction of the outboard motor, wherein the left exhaust manifold and the right exhaust manifold communicate, respectively, with the exhaust ports in the left bank and the right bank.

5. The exhaust apparatus of claim 1, wherein the exhaust pipe is deflected to a side opposite to openings of the exhaust ports in communication with the exhaust passage in the exhaust manifold, and the exhaust collection space adapted to collect exhaust gas from the exhaust ports is formed between the exhaust pipe and the openings of the exhaust ports.

* * * * *